US007071623B2

(12) United States Patent
Fujitani

(10) Patent No.: US 7,071,623 B2
(45) **Date of Patent: *Jul. 4, 2006**

(54) PLASMA DISPLAY

(75) Inventor: Morio Fujitani, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 129 days.

This patent is subject to a terminal disclaimer.

(21) Appl. No.: 10/485,215

(22) PCT Filed: Apr. 17, 2003

(86) PCT No.: PCT/JP03/04899

§ 371 (c)(1),
(2), (4) Date: Jan. 29, 2004

(87) PCT Pub. No.: WO03/088298

PCT Pub. Date: Oct. 23, 2003

(65) Prior Publication Data

US 2004/0207324 A1 Oct. 21, 2004

(30) Foreign Application Priority Data

Apr. 18, 2002 (JP) ..... 2002-115855
Apr. 18, 2002 (JP) ..... 2002-115856
Apr. 18, 2002 (JP) ..... 2002-115857
Apr. 18, 2002 (JP) ..... 2002-115858

(51) Int. Cl.
*H01J 17/49* (2006.01)

(52) U.S. Cl. ..... 313/586; 313/582; 313/587

(58) Field of Classification Search ..... 313/582–587; 315/169.3, 169.4; 345/74.1–76, 55, 60
See application file for complete search history.

(56) References Cited

U.S. PATENT DOCUMENTS 5,736,815 A * 4/1998 Amemiya ..... 313/586
6,433,477 B1 * 8/2002 Ha et al. ..... 313/586
6,525,470 B1 * 2/2003 Amemiya ..... 313/586
6,611,099 B1 * 8/2003 Murata et al. ..... 313/582
RE38,357 E * 12/2003 Amemiya et al. ..... 313/582
6,812,641 B1 * 11/2004 Fujitani et al. ..... 313/587
2001/0015623 A1 * 8/2001 Takada et al. ..... 313/586

FOREIGN PATENT DOCUMENTS

EP 0 860 849 8/1998
JP 10-92326 4/1998
JP 2000-285811 10/2000
JP 2001-118520 4/2001
JP 2001-160361 6/2001

* cited by examiner

*Primary Examiner*—Edward J. Glick
*Assistant Examiner*—Elizabeth Keaney
(74) *Attorney, Agent, or Firm*—Wenderoth, Lind & Ponack, L.L.P.

(57) ABSTRACT

A plasma display device comprises display electrodes that are opposingly formed for each display line on a front substrate with a discharge gap interposed, a dielectric layer formed in a manner covering the display electrodes, and a phosphor layer that emits light due to discharge between the display electrodes. At least one recess is formed on a surface of each of discharge cells on a side of a discharge space of the dielectric layer, and discharge electrodes that constitute the display electrodes are formed in a manner projecting out toward a discharge gap so that they face each other with the discharge gap interposed in a bottom region of the at least one recess.

20 Claims, 16 Drawing Sheets

PLASMA DISPLAY

TECHNICAL FIELD

The present invention relates to plasma display devices known as display devices.

BACKGROUND ART

In recent years, there has been an increasing expectation on large-shield wall-hung televisions for use as bidirectional information terminals. As display devices for this purpose, many types of displays are available such as a liquid crystal display panel, a field emission display and an electroluminescent display. Among them, a plasma display panel (hereinafter referred to as PDP) is drawing attention as a flat display device with good visibility because of self-luminescence, ability to display beautiful pictures, and ease of realizing larger shield sizes, and efforts are being made to achieve higher definition and larger shield sizes.

Driving schemes of PDP can be broadly divided into an AC type and a DC type. Thebacke two types of discharge schemes, namely, surface discharge type and opposing discharge type. Currently, AC type and surface discharge type PDP's are dominant from standpoints of achieving higher definition and larger shield, and simplicity of manufacturing.

FIG. 20 shows an example of a conventional PDP panel structure. As illustrated in FIG. 20, this PDP is comprised of front panel 1 and back panel 2.

Front panel 1 is comprised of transparent front substrate 3, a plurality of display electrodes 6, dielectric layer 7, and protective film 8. Front substrate 3 is a glass substrate such as made from boron silicide sodium glass fabricated by a floating method. Each display electrode 6 consists of a scan electrode 4 and sustain electrode 5, and a plurality of these pairs are laid out on front substrate 3 in a striped manner. Dielectric layer 7 is formed in a manner covering a group of display electrodes 6, and protective film 8 made from MgO is formed on dielectric layer 7.

Here, scan electrode 4 and sustain electrode 5 consist of transparent electrodes 4*a*, 5*a* that serve as discharge electrodes and bus electrodes 4*b*, 5*b* that are electrically connected with transparent electrodes 4*a*, 5*a*, respectively. Bus electrodes 4*b*, 5*b* are formed from such material as Cr/Cu/Cr, Ag or the like.

Back panel 2 consists of back substrate 9, address electrodes 10, dielectric layer 11, a plurality of stripe-shaped barrier ribs 12, and phosphor layers 13. Address electrodes 10 are formed on back substrate 9 that is disposed opposite front substrate 3 in a direction orthogonal to display electrodes 6. Dielectric layer 11 is formed in a manner covering address electrodes 10. Ribs 12 are formed on dielectric layer 11 between address electrodes 10 and in parallel to address electrodes 10. Phosphor layer 13 is formed on sides between ribs 12 and on a surface of dielectric layer 11. Here, for a purpose of displaying colors, phosphor layer 13 normally consists of three sequentially disposed colors of red, green, and blue. Front and back panels 1, 2 are opposed to each other across a minute discharge space with display electrodes 6 orthogonal to address electrodes 10, and their periphery is sealed with a sealing member. A discharge space is filled with discharge gas, which is made by mixing for example, neon (Ne) and xenon (Xe), at a pressure of about 66,500 Pa (500 Torr). In this way, the PDP is formed.

The discharge space of this PDP is partitioned into a plurality of sections by barrier ribs 12, and a plurality of discharge cells or light-emitting pixel regions is each defined by barrier ribs 12 and display and address electrodes 6, 10 that are orthogonal to each other.

With this PDP, discharge is caused by periodic application of voltage to address electrode 10 and display electrode 6, and ultraviolet rays generated by this discharge are applied to phosphor layer 13, thereby being converted into visible light. In this way, an image is displayed.

As shown in FIG. 14, scan and sustain electrodes 4, 5 of display electrode 6 are disposed with discharging gap 14 between these electrodes 4, 5. Light-emitting pixel region 15 is a region surrounded by this display electrode 6 and barrier ribs 12, and non-light-emitting pixel region 16 is an adjoining gap or region between adjacent display electrodes 6. Also, a black stripe is sometimes formed in non-light-emitting pixel region 16 for a purpose of improving contrast.

For development of a PDP, further effort toward higher luminance, higher efficiency, lower power consumption, and lower cost are essential. In order to achieve a higher efficiency, it is essential to control discharge in each region of each light-emitting pixel. Especially in an area of spread of discharge perpendicular to display electrodes 6, as bus electrodes 4*b*, 5*b* shield light emitted by the phosphor, it is effective to control discharge from spreading to a shielded area.

As an approach to efficiency improvement, a method is known, as disclosed in Japanese Patent Laid-Open Application No. H8-250029, for example, in which discharge in an area shielded by bus electrodes 4*b*, 5*b* is suppressed by increasing a thickness of dielectric layer 7 on bus electrodes 4*b*, 5*b*.

However, in the conventional structure as described above, although discharge in a direction perpendicular to the display electrodes is suppressed, discharge in a direction parallel to the display electrodes is not suppressed and spreads to a neighborhood of barrier ribs. In this case, there is a possibility of lowering of an electron temperature due to ribs and reduction in efficiency due to occurrence of recombination of electrons and ions.

SUMMARY OF THE INVENTION

The plasma display device of the present invention includes a front substrate and a back substrate that are opposingly disposed in a manner such that discharge spaces partitioned by ribs are formed between the substrates, pairs of display electrodes comprising discharge electrodes that are opposingly disposed on the front substrate for each display line with discharge gaps interposed in a manner such that discharge cells are formed between the ribs and bus electrodes for supplying power to the discharge electrodes, and a dielectric layer formed in a manner covering the display electrodes. The dielectric layer has at least one recess formed in a surface on a side of the discharge space of each discharge cell, and the discharge electrodes are formed in a manner projecting out from the bus electrodes toward the discharge gap in a manner opposing each other in a bottom region of the recess with the discharge gap interposed.

With this structure, luminous efficiency can be improved and driving of the panel can be stabilized.

DETAILED DESCRIPTION OF THE PREFERRED EMBODIMENTS

Figure 1:
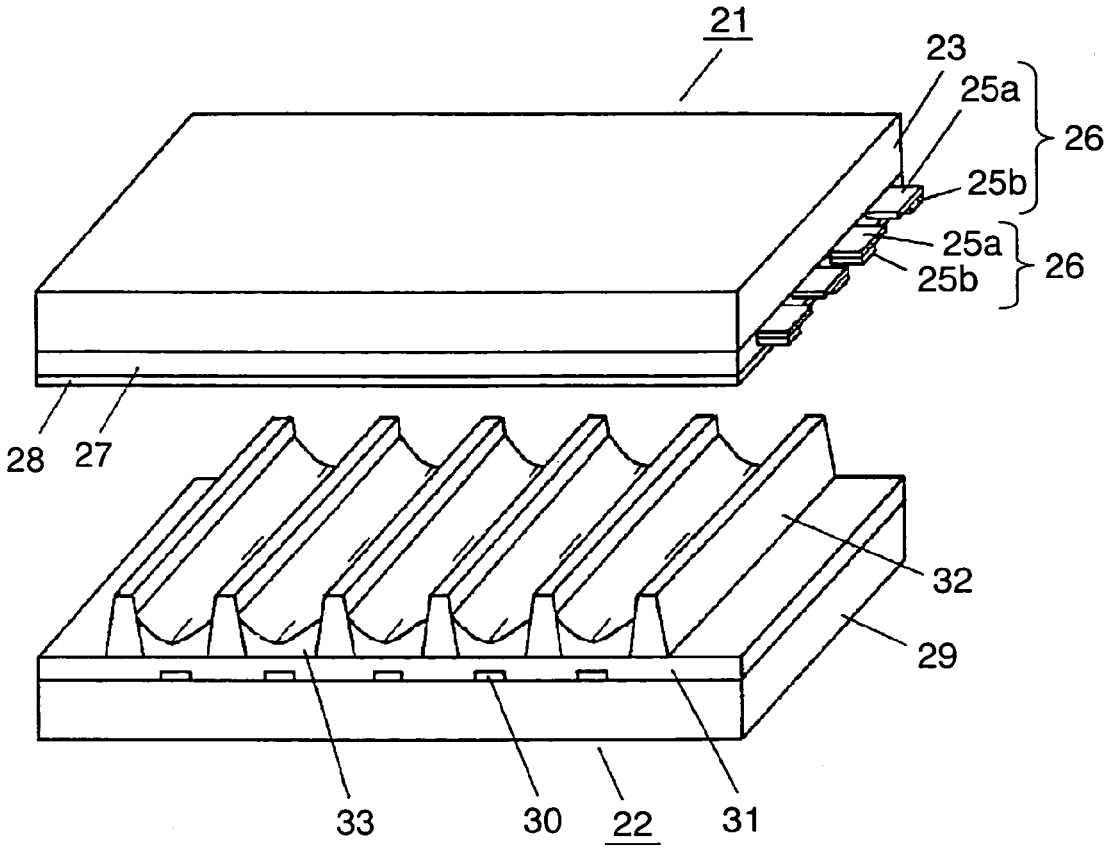
FIG. 1 is a sectional perspective view to illustrate a schematic structure of a plasma display device in Preferred Embodiment—1 of the present invention.

Referring to drawings, a description of plasma display devices in preferred embodiments of the present invention will now be given below. In the drawings, similar structural components have the same reference numerals.

Preferred Embodiment—1

FIG. 1 is a sectional perspective view of an example of a panel structure of a plasma display panel (PDP) as used in a plasma display device in Preferred Embodiment—1 of the present invention.

As illustrated in FIG. 1, the PDP consists of front panel 21 and back panel 22. Front panel 21 consists of transparent front substrate 23, a plurality of display electrodes 26, dielectric layer 27, and protective film 28. Front substrate 23 is a glass substrate made of boron silicate sodium glass prepared by a float process, for example. A plurality of display electrodes 26 are formed on front substrate 23 and consist of discharge electrodes 25*a* that are opposingly formed with a discharge gap interposed, and a bus electrode 25*b* which is electrically connected to a corresponding discharge electrode 25*a* for supplying power. Dielectric layer 27 is formed in a manner covering display electrodes 26, and protective film 28 made of magnesium oxide (MgO) is formed on dielectric layer 27. A plurality of display electrodes 26 are formed as pairs of a scan electrode and a sustain electrode.

Back panel 22 consists of back substrate 29, address electrodes 30, dielectric layer 31, a plurality of striped ribs 32, and phosphor layers 33.

Address electrodes 30 are formed on back substrate 29 that is disposed facing front substrate 23. Dielectric layer 31 is formed in a manner covering address electrodes 30. A plurality of striped ribs 32 are formed on dielectric layer 31 inbetween address electrodes 30 and parallel to them. Phosphor layers 33 are formed on sides of ribs 32 and on a surface of dielectric layer 31. Incidentally, for a purpose of displaying colors, phosphor layers 33 normally consist of sequentially disposed red, green, and green phosphors.

Front panel 21 and back panel 22 are opposingly disposed with a minute discharge space interposed in a manner such that display electrodes 26 and address electrodes 30 intersect at right angles, and a periphery is sealed with a sealing member. A discharge gas prepared by mixing xenon (Xe) and neon (Ne) or helium (He) is filled into the discharge space at a pressure of about 66,500 Pa (500 Torr).

This discharge space is divided by ribs 32 into a plurality of sections, and a discharge cell, being a unitary light-emitting region, is formed at a place where display electrodes 26 and address electrodes 30 intersect at right angles.

Also, black stripes may be formed between discharge cells for a purpose of improving contrast.

With this PDP, discharge is caused by periodic application of voltage to address electrodes 30 and display electrodes 26, and ultraviolet rays generated by this discharge are applied to phosphor layer 13, thereby being converted into visible light. In this way, an image is displayed.

Figure 2:
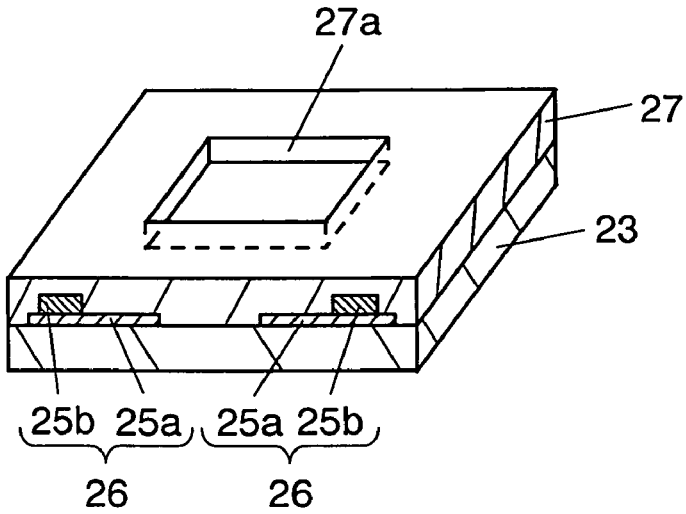
FIG. 2 is a perspective view of a section of a front panel of the plasma display device.

FIG. 2 is a sectional perspective view of a front panel of a plasma display device in Preferred Embodiment—1 of the present invention. In FIG. 2, recess 27*a* is formed for each discharge cell in a surface on a side of the discharge space of dielectric layer 27 that is formed on front substrate 23 in a manner covering display electrodes 26.

Figure 3:
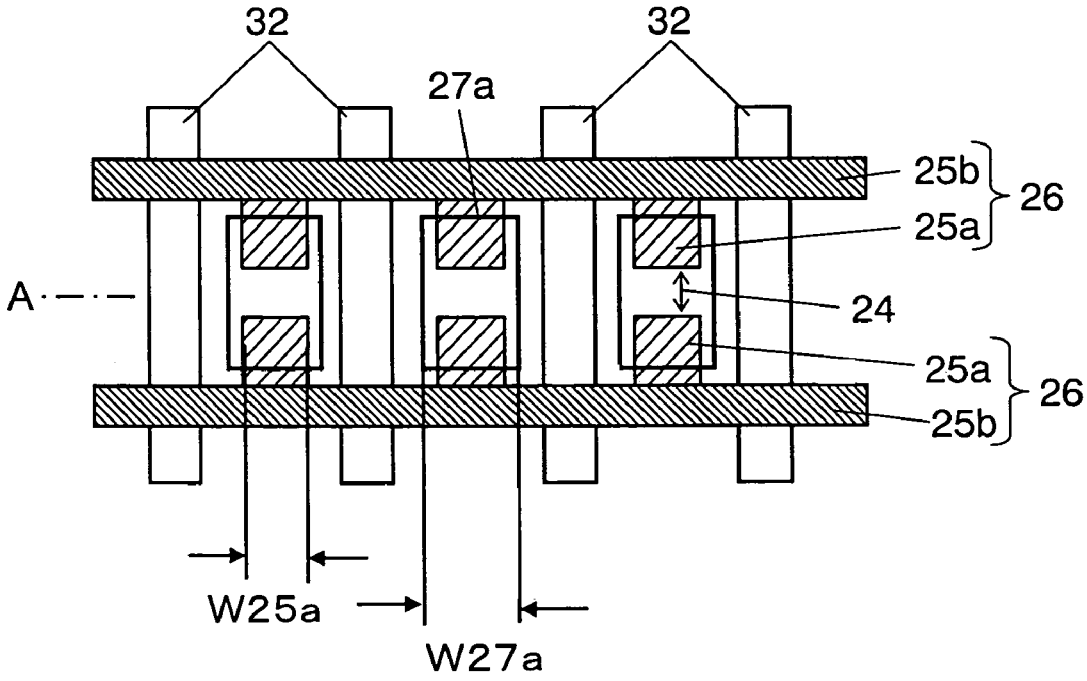
FIG. 3 is a plan view for illustrating a positional relationship of key parts of the plasma display device.

FIG. 3 illustrates a positional relationship among recess 27*a*, display electrodes 26, and ribs 32. As shown in FIG. 3, recess 27*a* is formed between ribs 32.

Display electrodes 26 consist of discharge electrode 25*a* made of a transparent electrode, and bus electrode 25*b* for supplying power to discharge electrode 25*a*. Discharge electrodes 25*a* in a discharge cell are formed in a manner projecting out in a direction orthogonal to bus electrodes 25*b* so that they face each other with discharge gap 24 interposed in each display line A. That is, discharge electrodes 25*a* in a discharge cell are situated in a bottom region of recess 27*a*. A width, W25*a*, of that part of discharge electrodes 25*a* in a discharge cell which face each other with discharge gap 24 interposed is made equal to or less than a width, W27*a*, of recess 27*a*. In the example illustrated in FIG. 3, the width, W25*a*, of those parts of discharge electrodes 25*a* which face each other with discharge gap 24 interposed in a discharge cell is less than the width, W27*a*, of recess 27*a*.

Here, in order to achieve a higher efficiency of the PDP, it is essential to control discharge in each region of a light-emitting pixel. Especially in a region in which discharge in a direction perpendicular to display electrodes 26 spreads, as bus electrodes 25*b* shield light from phosphor 33 thus making it useless, it is effective to control the discharge from spreading to a region to be shielded.

It is also effective for efficiency improvement to control not only the discharge in the direction perpendicular to display electrodes 26 but also discharge in a parallel direction. This is because, when the discharge spreads in the direction parallel to display electrodes 26 up to a neighborhood of ribs 32, an electron temperature decreases near ribs 32, thus presenting a possibility of a reduction in efficiency.

Furthermore, when discharge takes place near ribs 32, ribs 32 are negatively charged and positive ions are attracted to ribs 32. As a result, ribs 32 are etched by occurrence of recombination of electrons and ions and by ion bombardment of ribs 32. There is a possibility that a portion of ribs 32 that is etched precipitates on phosphor 33, thus deteriorating a characteristic.

However, in this preferred embodiment, recess 27*a* is formed for each individual discharge cell and recess 27*a* is located between adjacent ribs 32, or a width of recess 27*a* is smaller than a distance between adjacent ribs 32. By forming recess 27*a* in this manner, discharge can be retained only in the bottom region of recess 27*a*. That is, the discharge can be deterred from spreading in the direction perpendicular to display electrodes 26 up to bus electrodes 25*b* where the light from phosphor 33 is shielded, or from spreading in the direction parallel to display electrodes 26 to the neighborhood of ribs 32. Furthermore, as MgO is applied on sides of recess 27*a*, there is no possibility of sides of recess 27*a* being etched. Still more, as discharge electrodes 25*a* in a discharge cell are situated in the bottom region of recess 27*a* and are formed in a manner projecting out in the direction orthogonal to bus electrodes 25*b* so that they face each other with discharge gap 24 interposed, discharge electrodes 25*a* in a discharge cell are at a distance from ribs 32. As a result, accumulation of electric charges in the neighborhood of ribs 32 is suppressed, and an advantage of suppressing discharge in the neighborhood of ribs 32 is further enhanced.

Here, when discharge electrodes 25*a* are formed with transparent electrodes, light emission from phosphor 33 can be efficiently removed.

To the contrary, when discharge electrodes 25*a* are formed with opaque metal electrodes similar to bus electrodes 25*b*, a cost reduction can be achieved. In this case, however, the light emission from phosphor 33 is shielded by discharge electrodes 25*a*. It is possible, though, to improve efficiency of removing the light emission by making an area of discharge electrodes 25*a* in the discharge cell small without changing a dimension of discharge gap 24. Examples of such structures are illustrated in FIG. 4 and FIG. 5.

Figure 4:
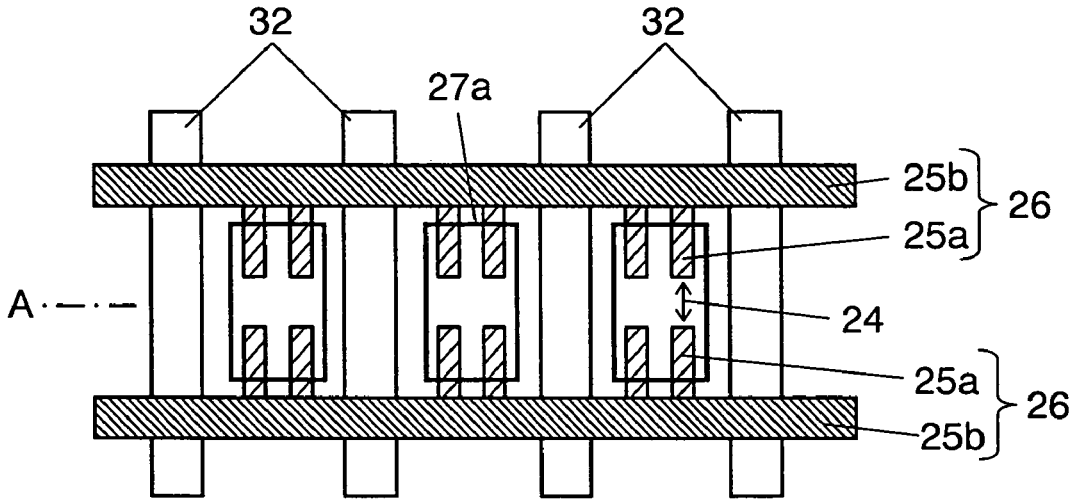
FIG. 4 is a plan view for illustrating a positional relationship of key parts of the plasma display device.
Figure 5:
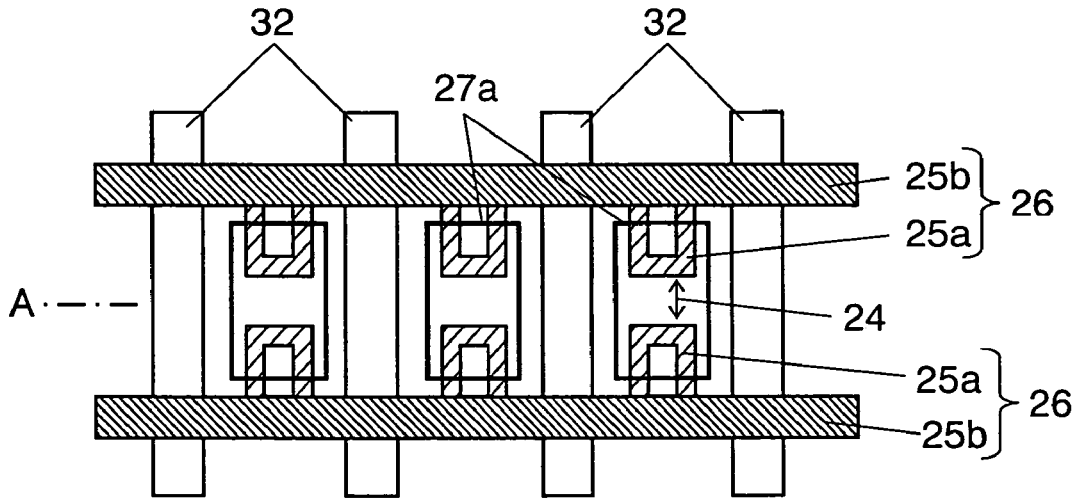
FIG. 5 is a plan view for illustrating a positional relationship of key parts of the plasma display device.

Discharge electrodes 25*a* in a discharge cell as illustrated in FIG. 4 are divided into two or more sections such as rectangles. Discharge electrodes 25*a* in a discharge cell as illustrated in FIG. 5 have a hollow shape made by removing a portion of discharge electrodes 25*a* shown in FIG. 3. By making an area of discharge electrodes 25*a* in a discharge cell in this way, the above-mentioned efficiency can be improved while enabling a reduction in electric power consumption. Same thing applies to a case where transparent electrodes are employed as discharge electrodes 25*a*.

Figure 6:
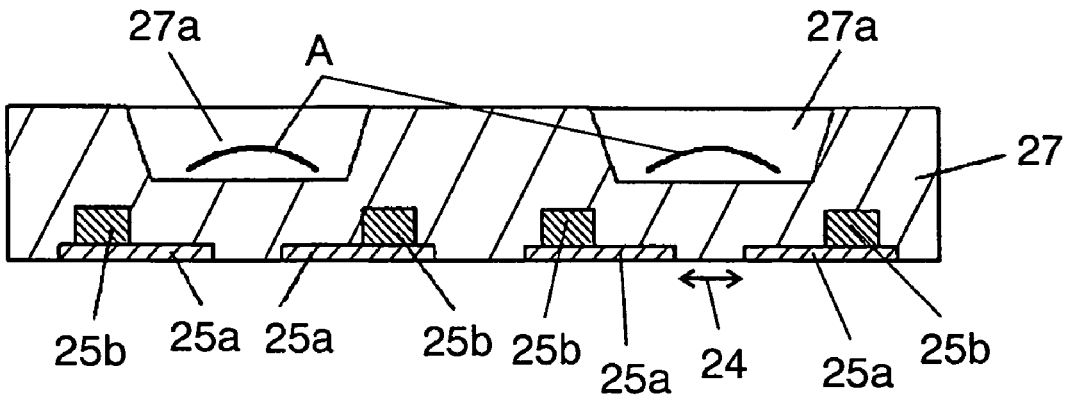
FIG. 6 is a schematic cross-sectional view of a structure of the front panel for illustrating a discharging state of the plasma display panel.
Figure 7:
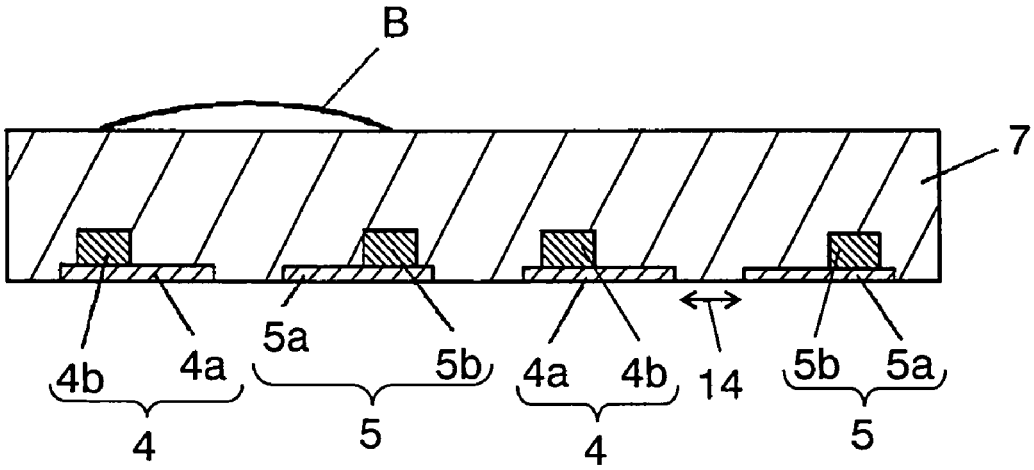
FIG. 7 is a cross-sectional view of a schematic structure of a front panel for illustrating a discharging state of a conventional plasma display panel.

Next, a description on control of a discharge region will be given with reference to FIG. 6 and FIG. 7. FIG. 6 is a cross-sectional view of a schematic structure of the front panel for illustrating a discharging state of a plasma display device in Preferred Embodiment—1. FIG. 7 is an illustration of a discharging state of a conventional plasma display device.

In conventional structure of FIG. 7 that does not have recesses, because a thickness of a dielectric layer is uniform, capacitance C is uniform over a surface of dielectric layer 27, and discharge B spreads as shown in FIG. 7. Accordingly, efficiency decreases for the reason described above.

To the contrary, as shown in FIG. 6, recess 27*a* is formed for each discharge cell thereby to make a thickness of that part of dielectric layer 27 thin and to increase capacitance C. As a result, charges for discharge are collectively formed in a bottom region of recess 27*a*. Also, as the thickness of dielectric layer 27 of the part where recess 27*a* is formed is thinner than other parts, discharge starts to take place in the bottom region of recess 27*a*.

Conversely speaking, as the thickness of dielectric layer 27*a* becomes thicker, except at the bottom region of recess 27*a*, capacitance of that part becomes smaller. That is, electric charges that exist in a thick part are fewer. Furthermore, because the thickness of dielectric layer 27 is greater, a discharge voltage is higher.

In addition, by projecting out discharge electrodes 25*a* in a discharge cell in adaptation to a shape of recess 27*a* and separating them from ribs 32, electric charges that accumulate in a neighborhood of ribs 32 are also suppressed.

As a result of these advantages, discharge A is restricted to the bottom region of recess 27*a* and efficiency is improved. Also, by applying this principle, it is possible to arbitrarily control an amount of electric charges that are formed in recess 27*a* by changing a size of recess 27*a*.

Also, it is generally known to increase a partial pressure of xenon (Xe) used as the discharge gas in order to achieve a higher efficiency of a PDP. However, when the partial pressure of xenon (Xe) is increased, not only a problem of an increase in discharge voltage occurs, but also a problem of causing easy saturation of luminance occurs due to an increase in ultraviolet rays that are produced. In order to avoid this, a method is known to decrease capacitance of a dielectric layer by increasing a thickness of the dielectric layer so as to decrease electric charges that are generated by a single pulse. In this case, however, a problem of efficiency reduction occurs as transmissivity of the dielectric layer itself decreases with an increasing thickness of the dielectric layer. Also, when the thickness is simply increased, a problem of further increase in the discharge voltage occurs.

However, according to the present invention, a discharge gas that is a mixture of xenon (Xe), neon (Ne) and/or helium (He) is filled in the discharge space with the partial pressure of xenon (Xe) set to a range 5 to 30%. And, by controlling current with the shape of recess 27*a*, prevention of luminance saturation that would otherwise occur at high xenon (Xe) partial pressure is enabled. Also, by changing the shape or size of recess 27*a*, an amount of current can be limited to an arbitrary value. Furthermore, in this preferred embodiment, as the current is controlled by dielectric layer 27 only, high xenon (Xe) partial pressure can be used without calling for a change in a circuit or driving method.

Figure 8A:
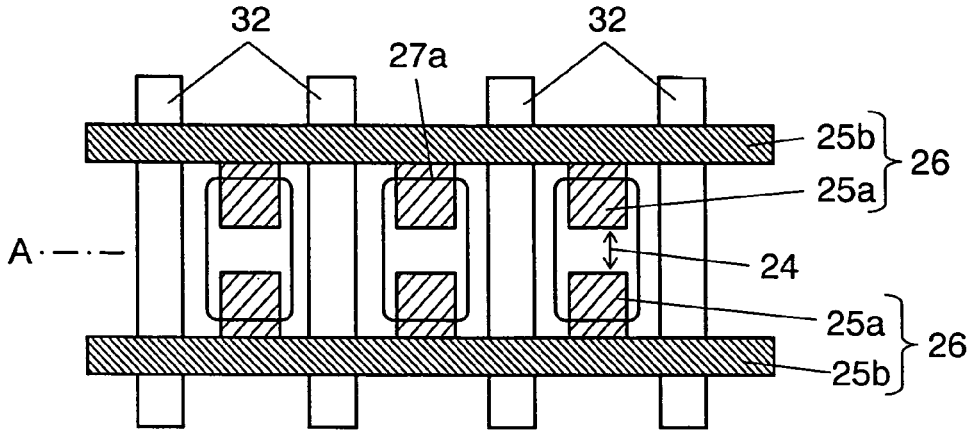
FIG. 8A, FIG. 8B and FIG. 8C are plan views for illustrating positional relationships of key parts of a plasma display device in Preferred Embodiment—1 of the present invention.
Figure 8B:
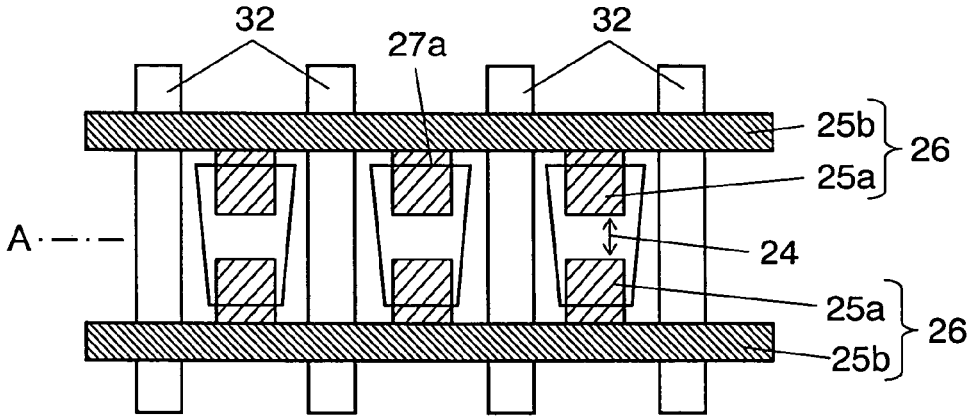
Figure 8C:
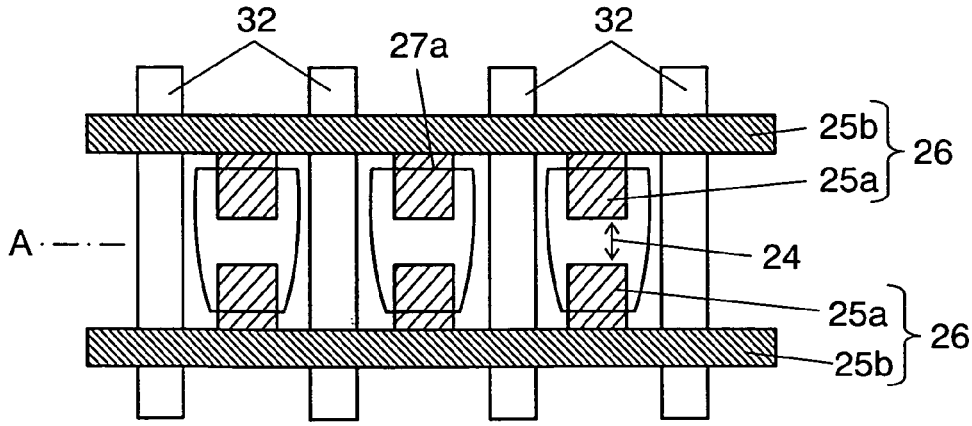

Here, the shape of recess 27*a* is not limited to a rectangle as shown in FIG. 3 and any shape is acceptable in so far as the width, W27*a*, is greater than the width, W25*a*, of that part where discharge electrodes 25*a* face each other with the discharge gap 24 interposed. FIG. 8A to FIG. 8C show examples of other shapes of recess 27*a*. A shape of recess 27*a* as shown in FIG. 8A is a rectangle with rounded corners. A shape of recess 27*a* as shown in FIG. 8B is a trapezoid. A shape of the recess as shown in FIG. 8C is a trapezoid with roundish sides. This shape includes oval or barrel-shaped shapes.

Figure 9A:
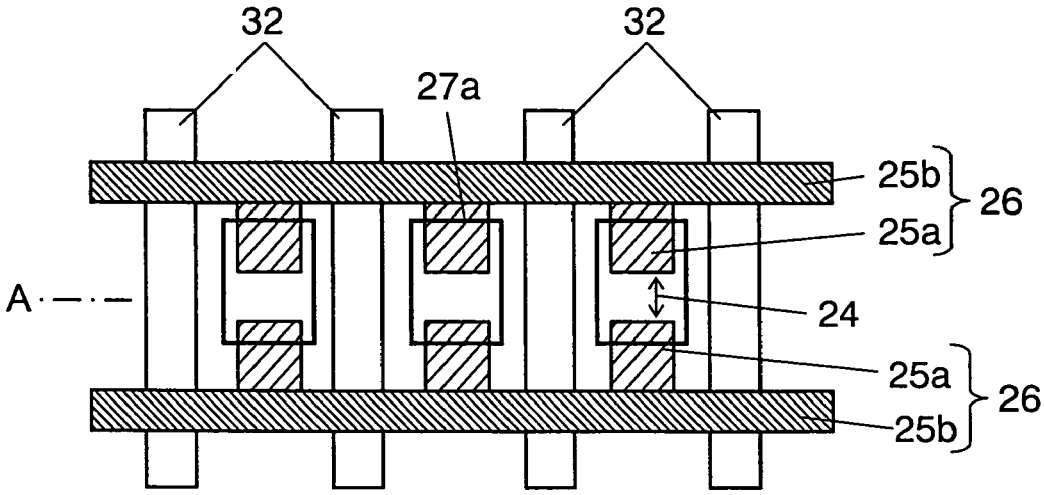
FIG. 9A and FIG. 9B are plan views for illustrating positional relationships of key parts of the plasma display device.
Figure 9B:
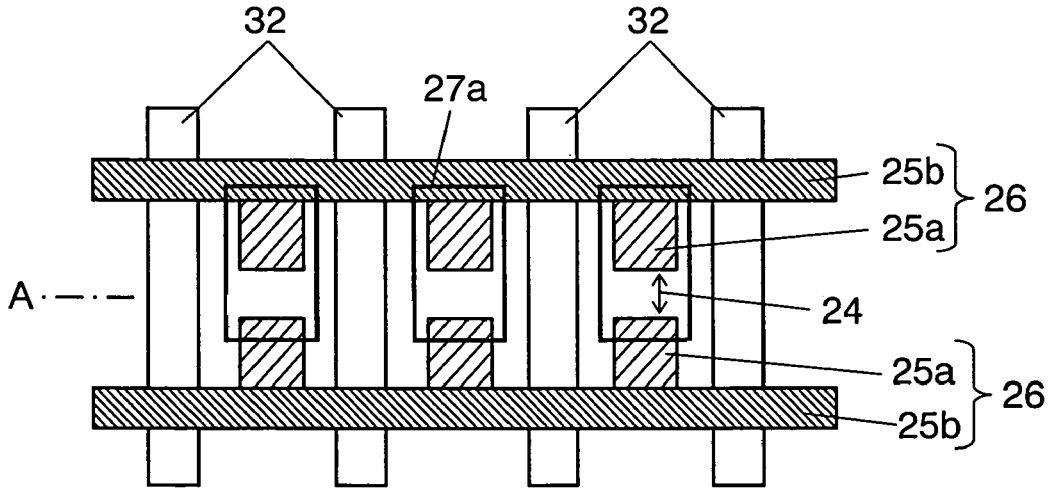

Also, by making the area of recess 27*a* on a side of a scan electrode, being one of the display electrodes 26, larger, discharge between scan electrodes and address electrodes 30 easily takes place, thus making it possible to widen a driving margin of the panel. Examples of such configurations are shown in FIG. 9A and FIG. 9B. FIG. 9A shows an example in which recess 27*a* is formed closer to the scan electrode relative to discharge gap 24 in order to increase an area in which recess 27*a* and display electrode 26, that serves as the scan electrode, face each other. FIG. 9B shows an example in which recess 27*a* is formed in a manner such that a part of it is located on bus electrode 25*b* of the scan electrode in order to enhance the above-mentioned advantage. In these structures, too, the shape of recess 27*a* may be as shown in FIG. 8A to FIG. 8C.

Figure 10A:
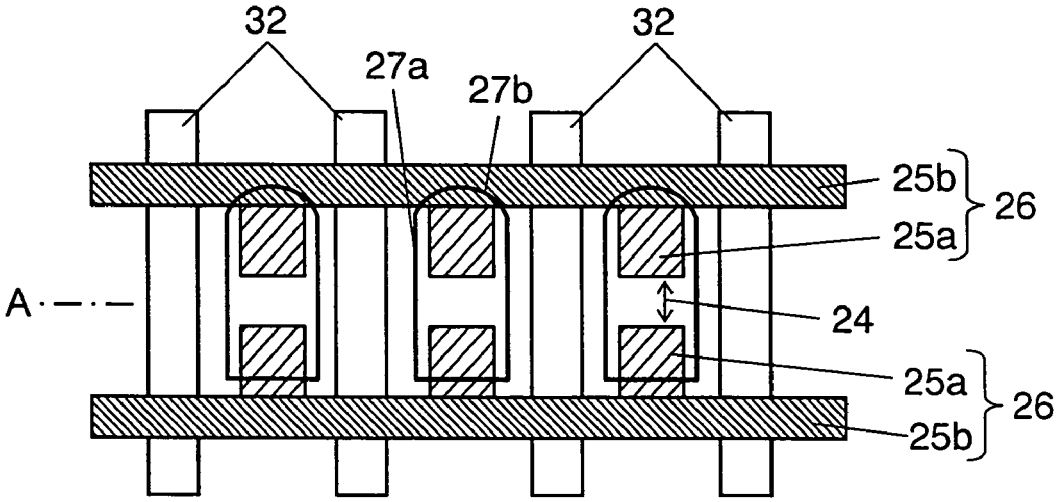
FIG. 10A and FIG. 10B are plan views for illustrating positional relationships of key parts of the plasma display device.
Figure 10B:
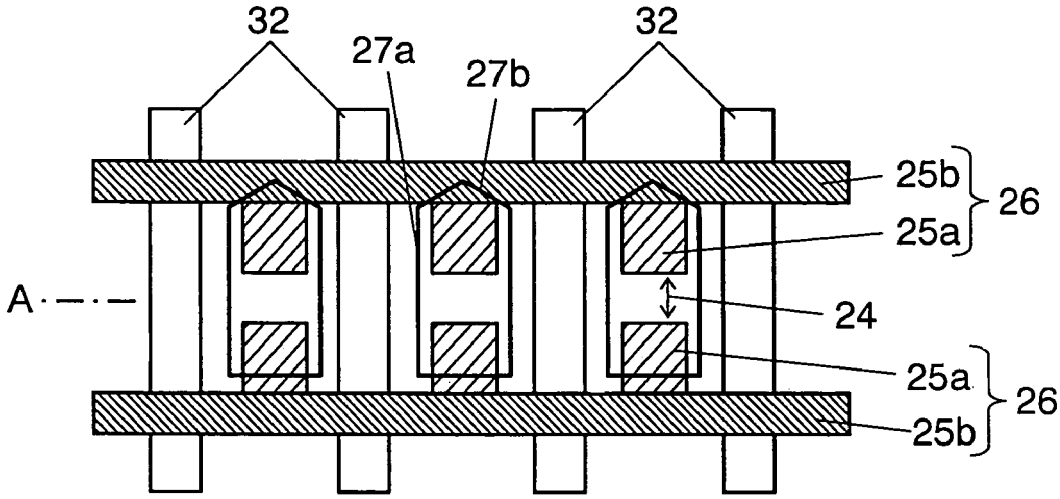

Here, in structure as shown in FIG. 9B, as a thickness of dielectric layer 27 becomes smaller on a part of bus electrode 25*b* due to recess 27*a*, there is a possibility of a dielectric breakdown strength of dielectric layer 27 being reduced on that part. Accordingly, it is preferable to form the part of recess 27*a* that is located on bus electrode 25*b* to be as small as possible. In order to do this, extended recess 27*b* made by protruding a part of recess 27*a* is formed in a manner facing bus electrode 25*b*. For example, curved extended recess 27*b* as illustrated in FIG. 10A is formed. Alternatively, pointed extended recess 27*b* is formed as illustrated in FIG. 10B.

In the above description, the shape of recess 27*a* can be polygonal, circular, or oval and is not limited to what is described above as long as the above object can be achieved.

Preferred Embodiment—2

Referring to drawings, a description of a plasma display device in Preferred Embodiment—2 of the present invention will be given. Difference of structure from that of Preferred Embodiment—1 of the present invention lies in a configuration of the recess. In the following, a detailed description of the difference will be given. Same reference numerals are given to those structural elements that are similar to those in Preferred Embodiment—1.

Figure 11:
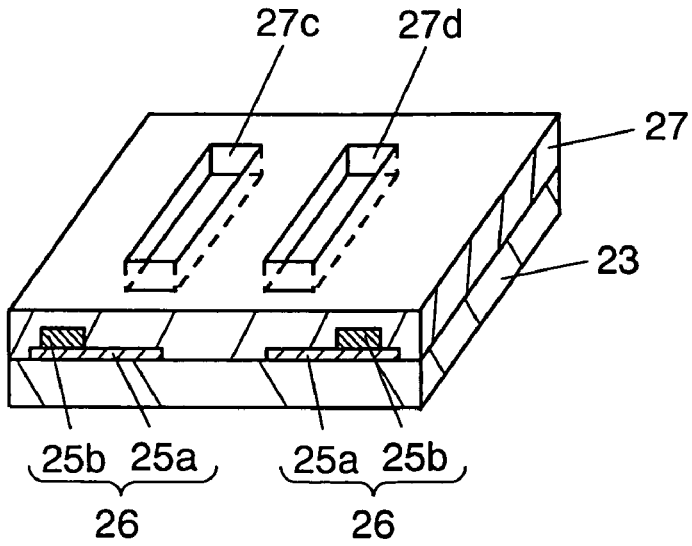
FIG. 11 is a perspective view of a part of a front panel of a plasma display device in Preferred Embodiment—2 of the present invention.
Figure 12:
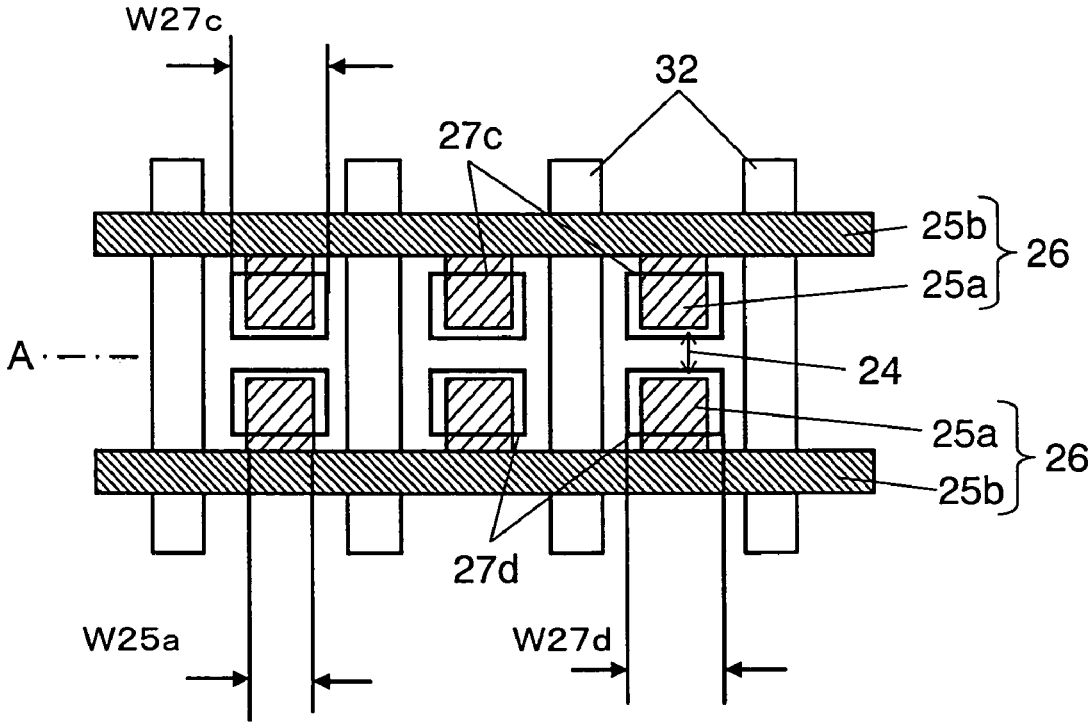
FIG. 12 is a plan view for illustrating a positional relationship of key parts of the plasma display device in Preferred Emodiment—2 of the present invention.

FIG. 11 is a partial perspective view of a front panel of the plasma display panel in Preferred Embodiment—2 of the present invention. In FIG. 11, two recesses 27*c* and 27*d* are formed in each discharge cell on a surface of a discharge space of dielectric layer 27 that covers display electrodes 26. Also, FIG. 12 illustrates a positional relationship among recess 27*c*, recess 27*d*, display electrodes 26 and ribs 32. As illustrated in FIG. 12, recess 27*c* and recess 27*d* are formed inbetween ribs 32.

Display electrodes 26 are comprised of discharge electrodes 25*a* consisting of transparent electrodes that are opposingly formed with discharge gap 24 interposed for each display line A, and bus electrodes 25*b* for supplying power to discharge electrodes 25*a*. Discharge electrodes 25*a* in a discharge cell are formed in a manner projecting out in a direction orthogonal to bus electrodes 25*b* so that they face each other with discharge gap 24 interposed. One of discharge electrodes 25*a* in a discharge cell is situated in a bottom region of recess 27*c* while the other discharge electrode faces the bottom region of recess 27*d*. A width, W25*a*, of discharge electrodes 25*a* that face each other with discharge gap 24 interposed is made equal to or smaller than a width W27*c* of recess 27*c* and width W27*d* of recess 27*d*. FIG. 12 illustrates an example in which the width (W25*a*) of that part of discharge electrodes 25*a* which oppose each other with discharge gap 24 interposed is made smaller than the width (W27*c*, W27*d*) of recesses 27*c*, 27*d*.

Figure 13:
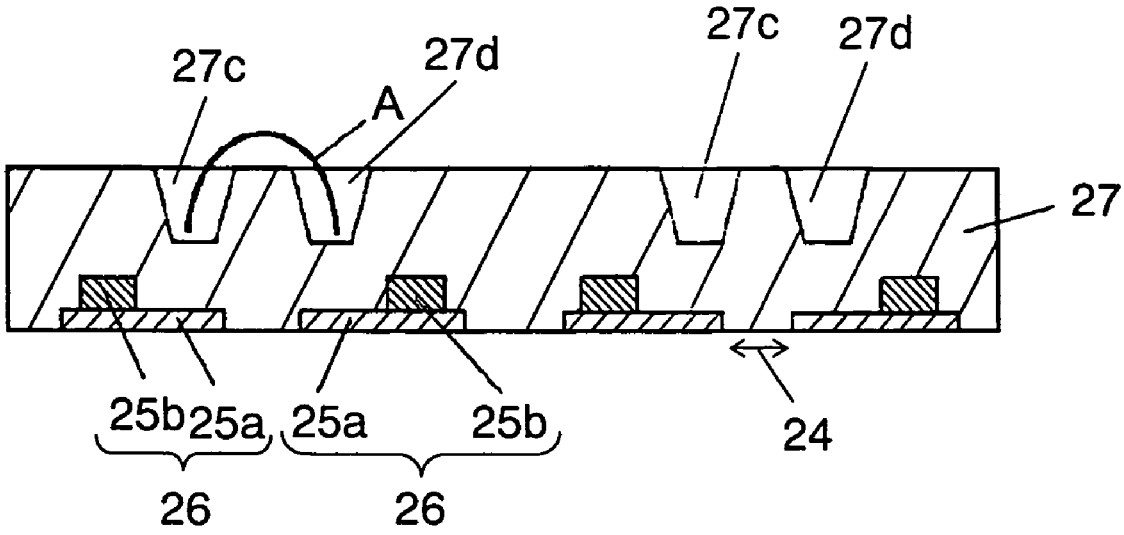
FIG. 13 is a schematic cross-sectional view of a structure of a front panel for illustrating a discharging state of the plasma display device in Preferred Emodiment—2 of the present invention.

FIG. 13 is an illustration of an advantage of forming two recesses 27*c*, 27*d* in dielectric layer 27 in the plasma display panel of Preferred Embodiment—2. In FIG. 13, solid line A represents a discharge.

In FIG. 13, as a thickness of that part of dielectric layer 27 where two recesses 27*c*, 27*d* are formed is thin, capacitance C of that part is large. As a result, charges for discharge are collectively formed in bottom regions of recess 27*c* and recess 27*d*, thereby limiting a discharging region.

Furthermore, in this structure, two recesses 27*c* and 27*d* are formed with discharge gap 24 interposed as shown in FIG. 13. Discharge A takes place between the bottom region of recess 27*c* and the bottom region of recess 27*d* with discharge gap 24 interposed. As a result, a discharge distance is extended, and a probability of exciting a discharge gas is increased, thus providing compatibility of control of discharge and high efficiency. This effect is more pronounced when partial pressure of xenon (Xe) in the discharge gas is increased.

Figure 14:
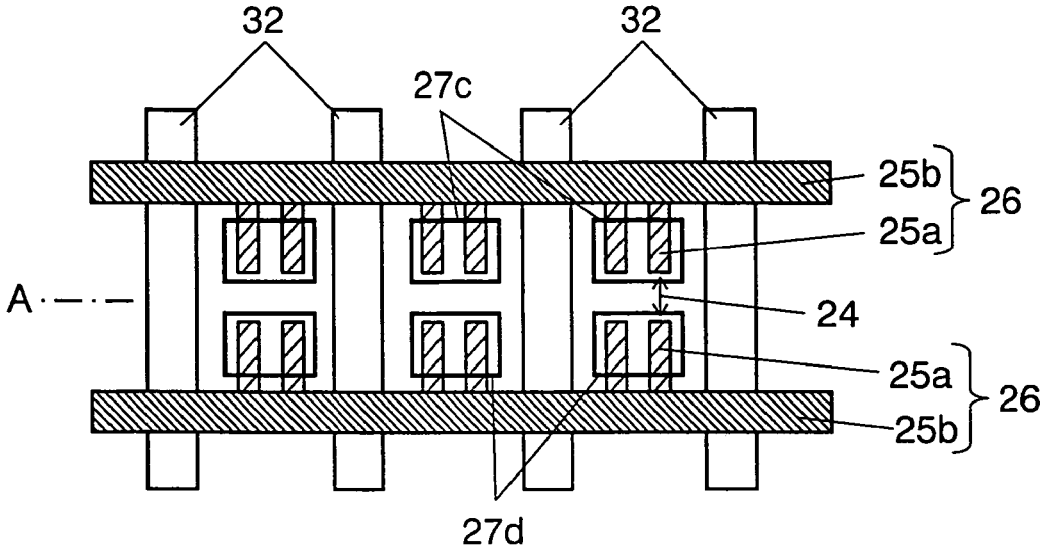
FIG. 14 is a plan view for illustrating a positional relationship of key parts of the plasma display device in Preferred Emodiment—2 of the present invention.
Figure 15:
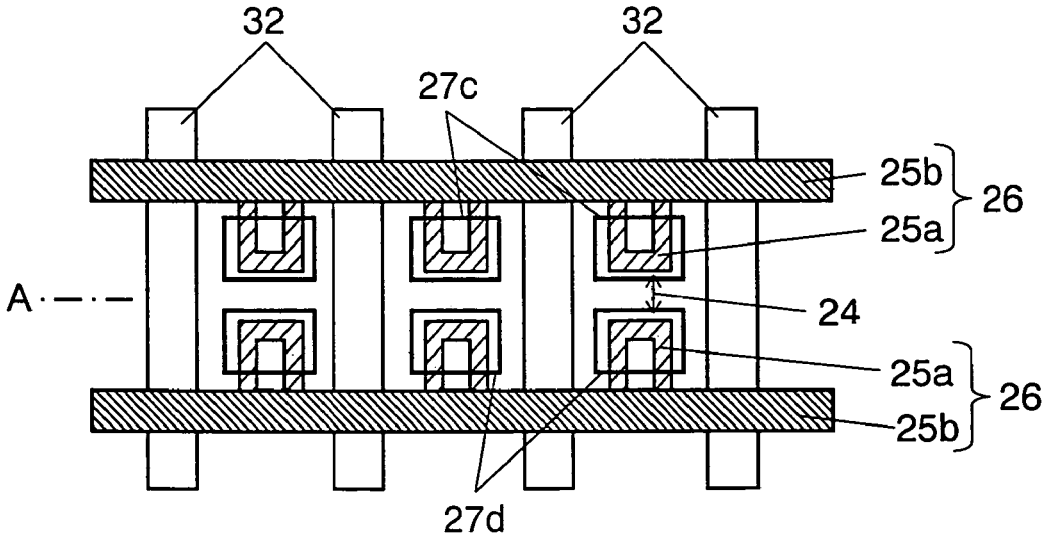
FIG. 15 is a plan view for illustrating a positional relationship of key parts of the plasma display device in Preferred Emodiment—2 of the present invention.

Discharge electrodes 25*a* in a discharge cell as illustrated in FIG. 14 represent a configuration in which they are divided into a plurarity of parts. Discharge electrodes 25*a* in a discharge cell shown in FIG. 15 are made hollow by gouging out discharge electrodes 25*a* as shown in FIG. 12. By decreasing an area of the discharge electrodes in this way, a similar advantage as described in Preferred Embodiment—1 in reference to FIG. 4 and FIG. 5 can be obtained.

Here, shapes of recess 27*c* and recess 27*d* are not limited to rectangles as shown in FIG. 12. As long as a width of recess 27*c* and recess 27*d* is greater than a width of a part that faces discharge electrodes 25*a* with discharge gap 24 interposed, shape does not matter.

Figure 16A:
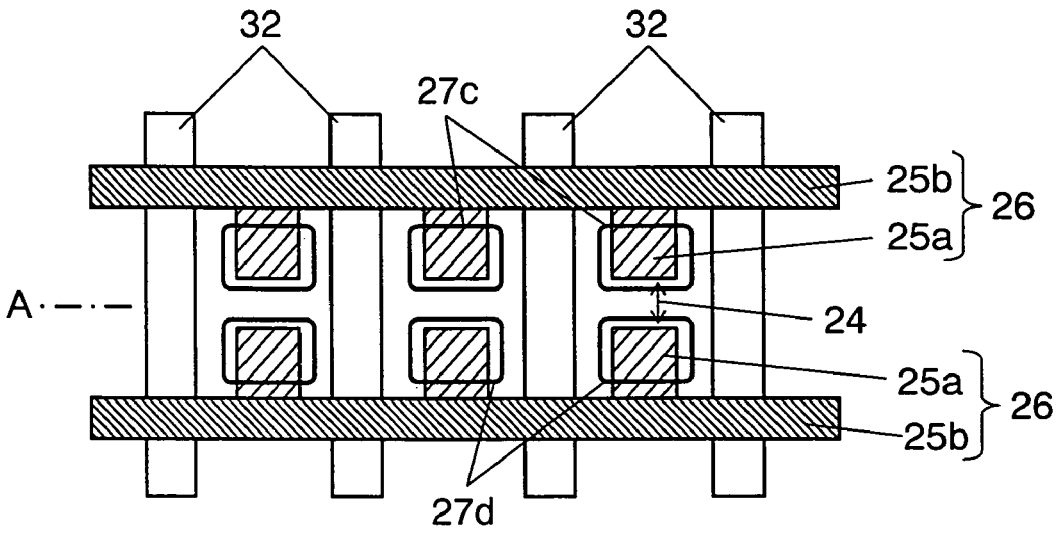
FIG. 16A and FIG. 16B are plan views for illustrating positional relationships of key parts of the plasma display device in Preferred Emodiment—2 of the present invention.
Figure 16B:
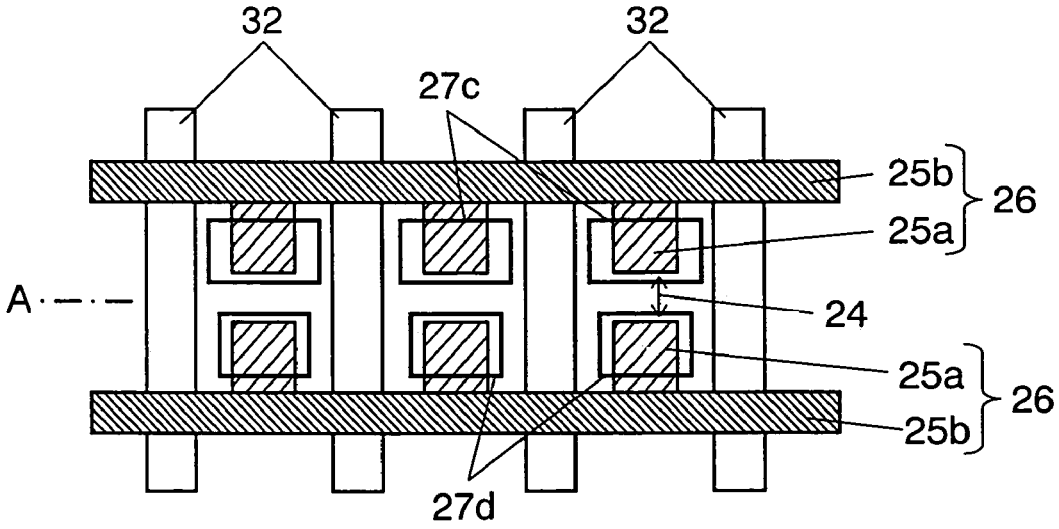

FIG. 16A and FIG. 16B illustrate examples of other shapes of recess 27*c* and recess 27*d*. A shape of recess 27*c* and recess 27*d* as shown in FIG. 16A is a rectangle with rounded corners. Recess 27*c* and recess 27*d* as shown in FIG. 16B differ in size.

Figure 17A:
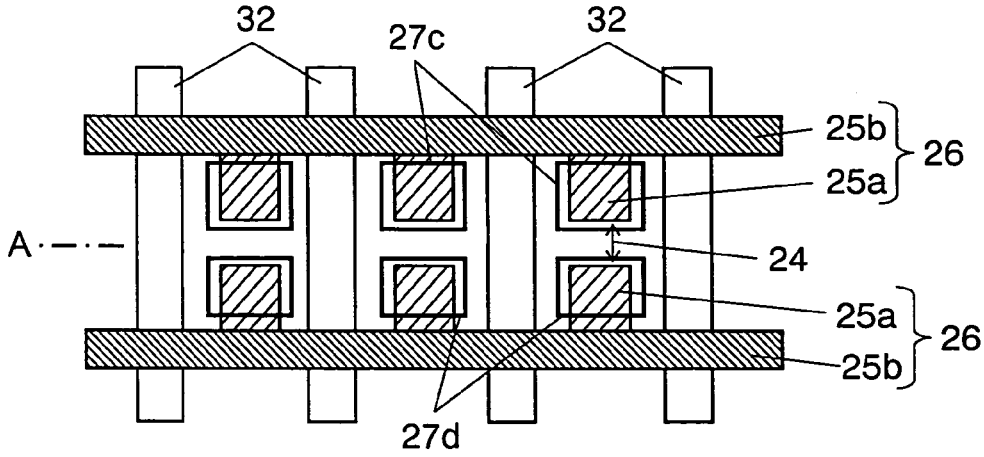
FIG. 17A, FIG. 17B and FIG. 17C are plan views for illustrating positional relationships of key parts of the plasma display device in Preferred Embodiment—2 of the present invention.
Figure 17B:
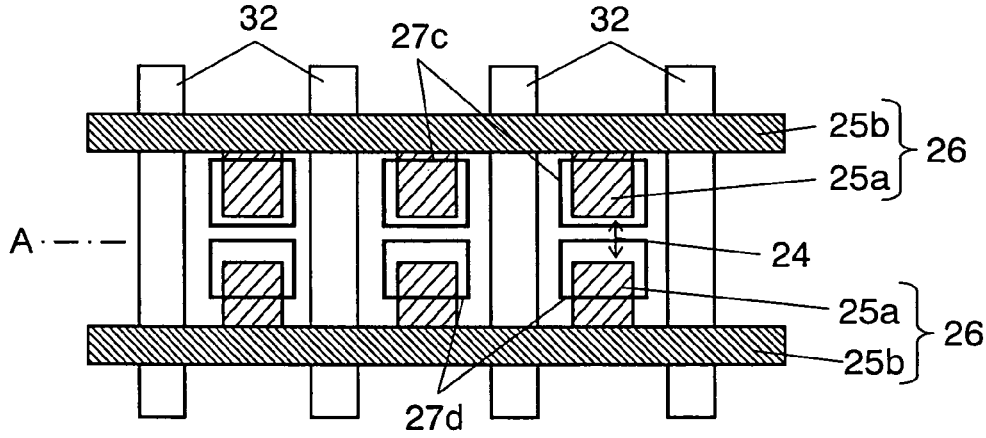
Figure 17C:
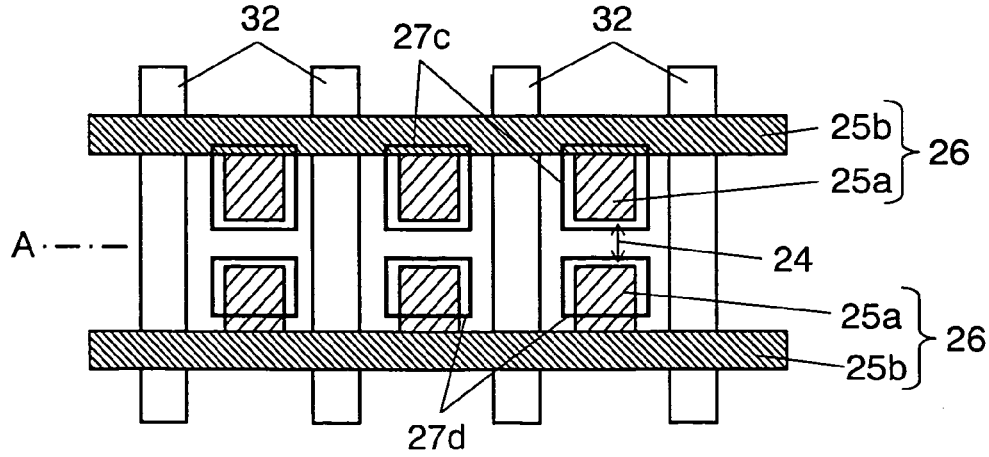

Also, by forming one of recess 27*c* and recess 27*d*, that oppose display electrode 26 to be used as a scan electrode, in a manner such that an opposing area is greater, discharge between the scan electrode and address electrode 30 easily takes place during an addressing operation. That is, a driving margin of the panel can be widened. Examples of such structures are shown in FIG. 17A to FIG. 17C. FIG. 17A illustrates an example of a structure in which an area of recess 27*c* that opposes the scan electrode is made greater by making a size of recess 27*c* greater than that of recess 27*d*. Also, FIG. 17B illustrates an example of a structure in which an overlapping area of recess 27*c* and discharge electrode 25*a* is made greater than an overlapping area of recess 27*d* and discharge electrode 25*a* by forming the recess 27*c* and discharge electrode 25*a* closer to the scan electrode relative to discharge gap 24, although sizes of recess 27*c* and recess 27*d* are the same. Also, FIG. 17C illustrates an example of a structure in which a part of recess 27*c* is formed on bus electrode 25*b* of the scan electrode in order to enhance the above-described advantage. Here again, shapes of recess 27*c* and recess 27*d* may be like those illustrated in FIG. 16A and FIG. 16B.

Figure 18A:
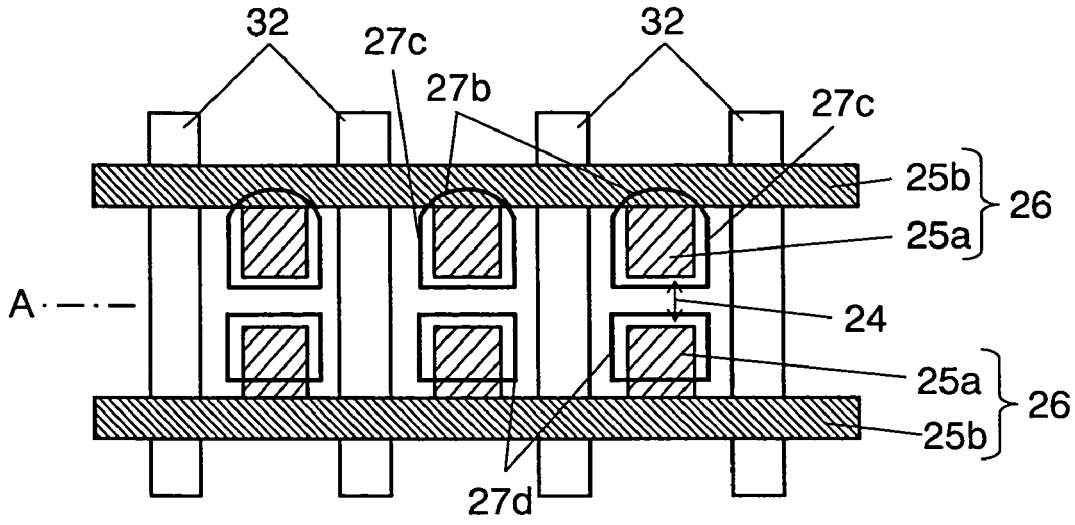
FIG. 18A and FIG. 18B are plan views for illustrating positional relationships of key parts of the plasma display device in Preferred Emodiment—2 of the present invention.
Figure 18B:
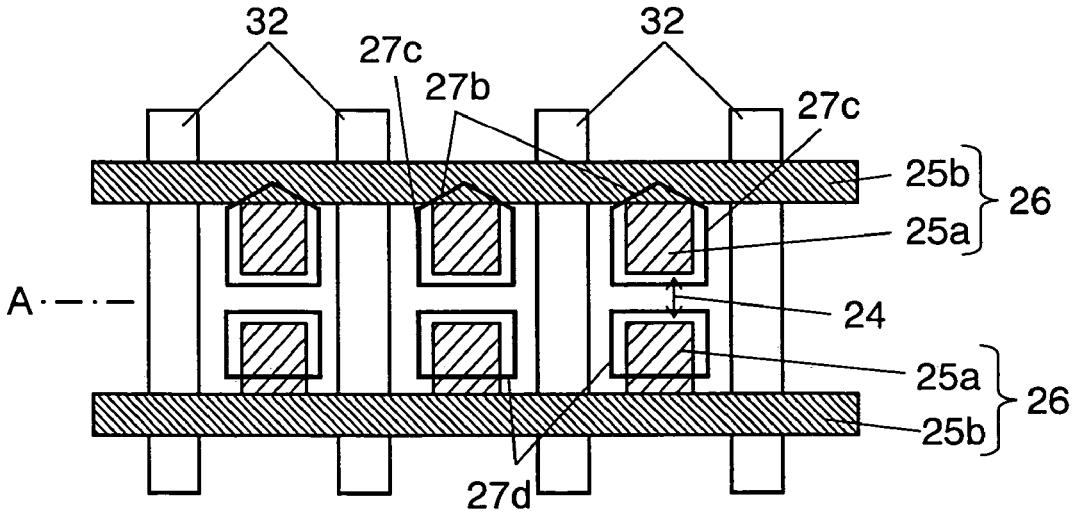

Here, in a case of a structure as shown in FIG. 17C, a thickness of dielectric layer 27 becomes thin because of that part of recess 27*c* which overlaps bus electrode 25*b*. For this reason, there is a possibility that a dielectric breakdown strength of dielectric layer 27 of this part is reduced. Therefore, it is preferable to form that part of recess 27*c* which overlaps bus electrode 25*b* to a smallest possible size. For this purpose, recess 27*c* having partly protruding extended recess 27*b* is formed and a bottom region of partly extended recess 27*b* is situated on bus electrode 25*b*. To be more specific, FIG. 18A shows an example of partly extended recess 27*b* that has a curved protrusion. Also, in FIG. 18B, an example of partly extended recess 27*b* having a pointed shape is shown.

Figure 19A:
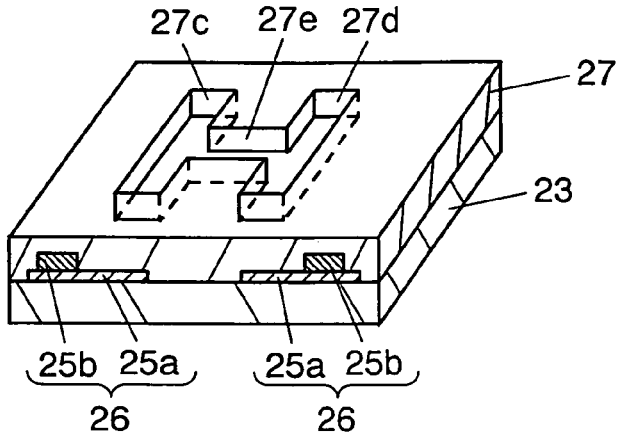
FIG. 19A, FIG. 19B and FIG. 19C are partial perspective views for illustrating configurations of a recess of the plasma display panel of the invention.
Figure 19B:
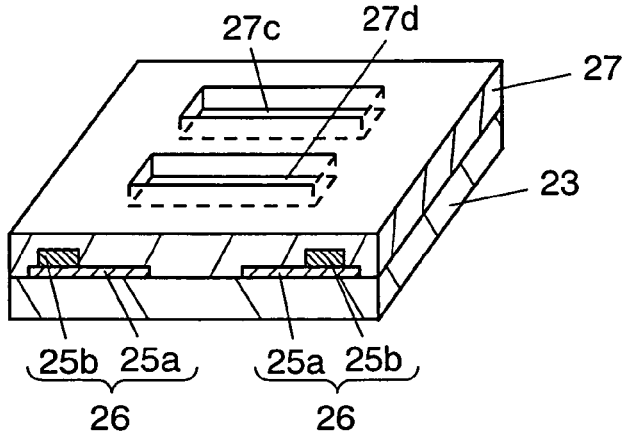
Figure 19C:
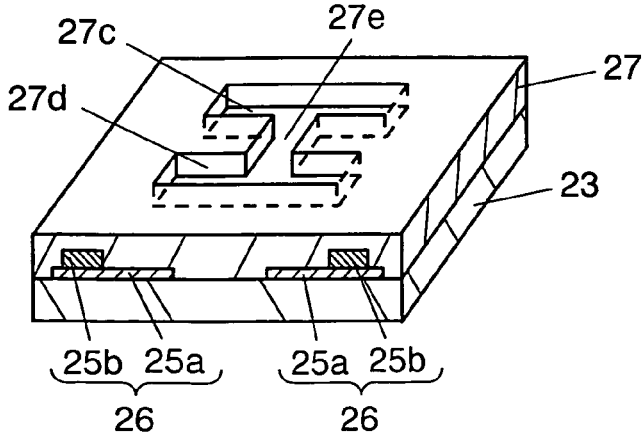
Figure 20:
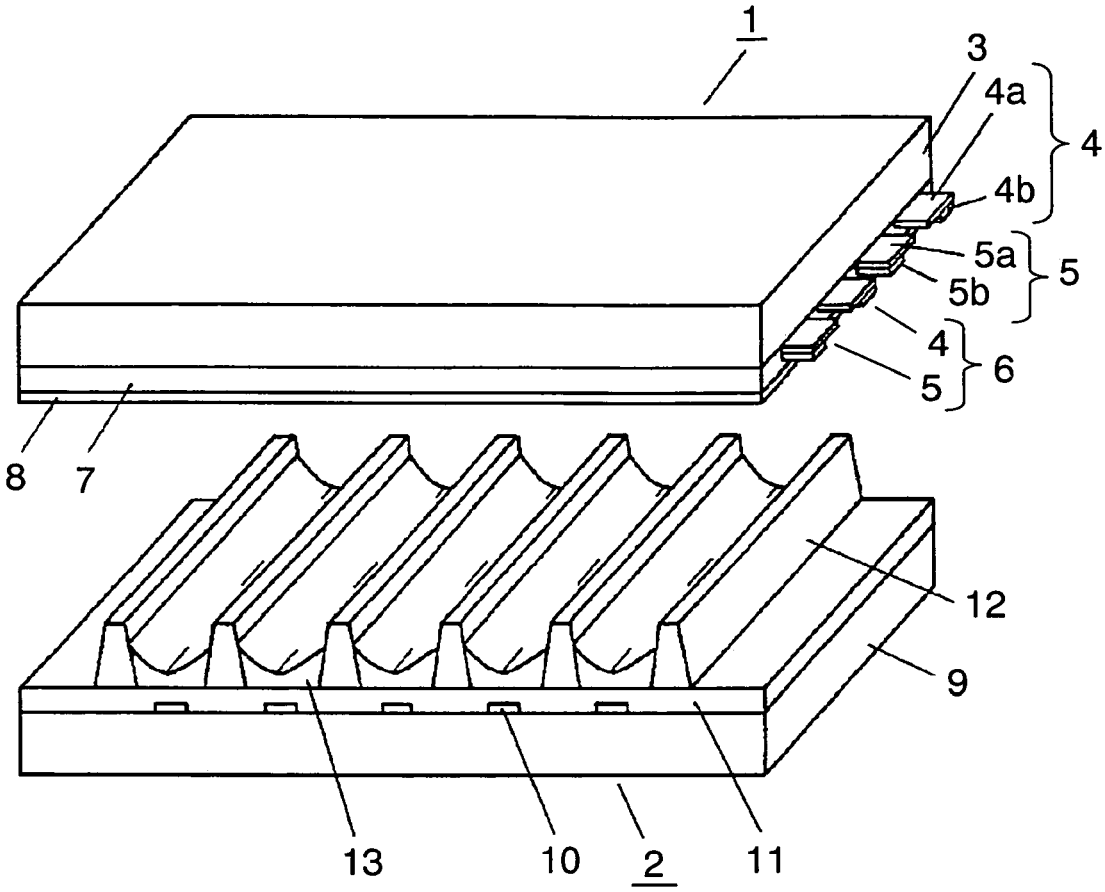
FIG. 20 is a schematic sectional perspective view of structure of a conventional plasma display device.
Figure 21:
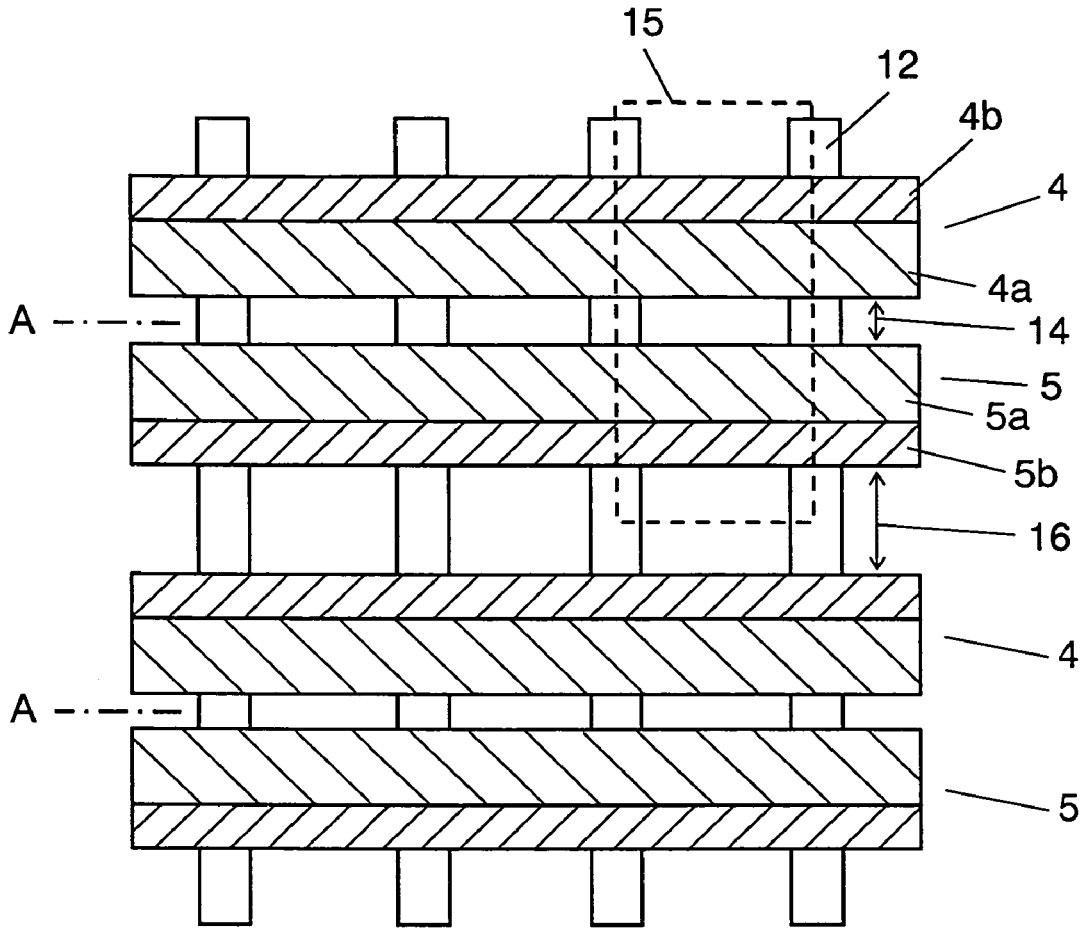
FIG. 21 is a plan view for illustrating a positional relationship of key parts of the conventional plasma display device.

Also, other embodiments of the recess are shown in FIG. 19A to FIG. 19C. In the example shown in FIG. 19A, at least one groove 27*e* is formed that connects recess 27*c* and recess 27*d* for each afore-described discharge cell. In this case, compatibility of a reduction in a discharge starting voltage and an increase in a discharge distance is obtained. In the example shown in FIG. 19B, two recesses 27*c*, 27*d* are formed parallel to each other in a direction orthogonal to bus electrodes 25*b*. In this case, the discharge starting voltage can be reduced. Furthermore, in the example shown in FIG. 19C, at least one groove 27*e* is formed that connects recess 27*c* and recess 27*d* shown in FIG. 19B.

In the above, although a description was made of an example of forming two recesses 27*c*, 27*d*, more than two recesses may be made and a shape of the recesses may be polygonal, circular, or oval. As long as the above object can be achieved, a shape of the recess is not limited to what is described above.

INDUSTRIAL APPLICABILITY

With the plasma display device in accordance with the present invention, discharge can be controlled while driving during an addressing period can be stabilized. Also, an efficiency improvement due to a high xenon (Xe) partial pressure can be effectively utilized, thereby enabling improvements in panel efficiency and picture quality.

The invention claimed is:

1. A plasma display device comprising:

a front substrate and a back substrate positioned so as to define a discharge space therebetween;

ribs between said front and back substrates so as to divide the discharge space;

two display electrodes, each of said two display electrodes including a discharge electrode on said front substrate and a bus electrode for supplying power to said discharge electrode, with each said discharge electrode projecting from a corresponding said bus electrode so as to define at a displaying line a discharge gap between said discharge electrodes, whereby a discharge cell is defined between said two display electrodes and two corresponding adjacent ones of said ribs;

a dielectric layer covering said two display electrodes; and two recesses in a portion of a surface of said dielectric layer corresponding to said discharge cell, with one of said discharge electrodes being at a bottom region of one of said two recesses and the other of said discharge electrodes being at a bottom region of the other of said two recesses.

2. The plasma display device according to claim 1, wherein a width of each of said discharge electrodes is not greater than a width of each of said two recesses, respectively.

3. The plasma display device according to claim 2, wherein each of said discharge electrodes comprises a transparent electrode.

4. The plasma display device according to claim 2, wherein a discharge gas to be filled in the discharge space comprises a mixed gas containing xenon and at least one of neon and helium, with a partial pressure of the xenon being in a range of from 5% to 30%.

5. The plasma display device according to claim 1, wherein each of said discharge electrodes comprises plural electrodes.

6. The plasma display device according to claim 5, wherein each of said discharge electrodes comprises a transparent electrode.

7. The plasma display device according to claim 5, wherein a discharge gas to be filled in the discharge space comprises a mixed gas containing xenon and at least one of neon and helium, with a partial pressure of the xenon being in a range of from 5% to 30%.

8. The plasma display device according to claim 1, wherein each of said discharge electrodes comprises an electrode having a portion thereof removed.

9. The plasma display device according to claim 8, wherein each of said discharge electrodes comprises a transparent electrode.

10. The plasma display device according to claim 8, wherein a discharge gas to be filled in the discharge space comprises a mixed gas containing xenon and at least one of neon and helium, with a partial pressure of the xenon being in a range of from 5% to 30%.

11. The plasma display device according to claim 1, wherein each of said discharge electrodes comprises a transparent electrode.

12. The plasma display device according to claim 11, wherein a discharge gas to be filled in the discharge space comprises a mixed gas containing xenon and at least one of neon and helium, with a partial pressure of the xenon being in a range of from 5% to 30%.

13. The plasma display device according to claim 1, wherein a discharge gas to be filled in the discharge space comprises a mixed gas containing xenon and at least one of neon and helium, with a partial pressure of the xenon being in a range of from 5% to 30%.

14. The plasma display device according to claim 1, wherein one of said two display electrodes is to be used as a scanning electrode, with an area of said one of said two display electrodes being covered by an area of one of said two recesses that is greater than an area of the other of said two display electrodes that is covered by the other of said two recesses.

15. The plasma display device according to claim 14, wherein each of said discharge electrodes comprises a transparent electrode.

16. The plasma display device according to claim 14, wherein a discharge gas to be filled in the discharge space comprises a mixed gas containing xenon and at least one of neon and helium, with a partial pressure of the xenon being in a range of from 5% to 30%.

17. The plasma display device according to claim 1, wherein one of said two recesses is situated over said bus electrode of a corresponding one of said display electrodes.

18. The plasma display device according to claim 1, wherein said two recesses are interconnected by at least one groove.

19. A plasma display device comprising:

a front substrate and a back substrate positioned so as to define a discharge space therebetween;

ribs between said front and back substrates so as to divide the discharge space;

two display electrodes, each of said two display electrodes including a discharge electrode on said front substrate and a bus electrode for supplying power to said discharge electrode, with each said discharge electrode projecting from a corresponding said bus electrode so as to define at a displaying line a discharge gap between said discharge electrodes, whereby a discharge cell is defined between said two display electrodes and two corresponding adjacent ones of said ribs;

a dielectric layer covering said two display electrodes; and at least one recess in a portion of a surface of said dielectric layer corresponding to said discharge cell, with said discharge electrodes being at a bottom region of said at least one recess, wherein said at least one recess includes an extended recess portion situated over said bus electrode of a corresponding one of said two display electrodes.

20. A plasma display device comprising:

a front substrate and a back substrate positioned so as to define a discharge space therebetween;

ribs between said front and back substrates so as to divide the discharge space;

two display electrodes, each of said two display electrodes including a discharge electrode on said front substrate and a bus electrode for supplying power to said discharge electrode, with each said discharge electrode projecting from a corresponding said bus electrode so as to define at a displaying line a discharge gap between said discharge electrodes, whereby a discharge cell is defined between said two display electrodes and two corresponding adjacent ones of said ribs;

a dielectric layer covering said two display electrodes; and two recesses formed in a portion of a surface of said dielectric layer corresponding to said discharge cell, with one of said discharge electrodes being at a bottom region of one of said two recesses and the other of said discharge electrodes being at a bottom region of the other of said two recesses, wherein one of said two recesses includes an extended recess portion situated over said bus electrode of a corresponding one of said two display electrodes.

* * * * *

UNITED STATES PATENT AND TRADEMARK OFFICE

CERTIFICATE OF CORRECTION

PATENT NO. : 7,071,623 B2
APPLICATION NO. : 10/485215
DATED : July 4, 2006
INVENTOR(S) : Morio Fujitani It is certified that error appears in the above-identified patent and that said Letters Patent is hereby corrected as shown below:

ON THE FRONT PAGE

Under U.S. Patent Documents, in Section (56), add
--5,742,122 4/1998 Amemiya et al.--.

Under U.S. Patent Documents, in Section (56), add
--6,333,599 12/2001 Kawanami et al.--.

Signed and Sealed this

Sixth Day of March, 2007

JON W. DUDAS
*Director of the United States Patent and Trademark Office*